US012798038B2

(12) United States Patent
Aida et al.

(10) Patent No.: US 12,798,038 B2
(45) Date of Patent: Nov. 17, 2026

(54) POLISHING DEVICE, POLISHING METHOD, AND COMPUTER-READABLE STORAGE MEDIUM

(71) Applicants: SANOH INDUSTRIAL CO., LTD., Tokyo (JP); NATIONAL UNIVERSITY CORPORATION NAGAOKA UNIVERSITY OF TECHNOLOGY, Niigata (JP); HITECHNOTH CORPORATION, Kanagawa (JP)

(72) Inventors: Hideo Aida, Niigata (JP); Haruji Katakura, Niigata (JP); Natsuko Omiya, Ibaraki (JP); Yasuyuki Kobori, Kanagawa (JP)

(73) Assignees: SANOH INDUSTRIAL CO., LTD., Tokyo (JP); NATIONAL UNIVERSITY CORPORATION NAGAOKA UNIVERSITY OF TECHNOLOGY, Niigata (JP); HITECHNOTH CORPORATION, Kanagawa (JP)

( * ) Notice: Subject to any disclaimer, the term of this patent is extended or adjusted under 35 U.S.C. 154(b) by 301 days.

(21) Appl. No.: 18/697,163

(22) PCT Filed: Sep. 9, 2022

(86) PCT No.: PCT/JP2022/036377
§ 371 (c)(1),
(2) Date: Mar. 29, 2024

(87) PCT Pub. No.: WO2023/054562
PCT Pub. Date: Apr. 6, 2023

(65) Prior Publication Data
US 2025/0041986 A1 Feb. 6, 2025

(30) Foreign Application Priority Data
Sep. 30, 2021 (JP) ..... 2021-161159

(51) Int. Cl.
*B24B 37/005* (2012.01)
*B24B 37/30* (2012.01)
*B24B 49/16* (2006.01)

(52) U.S. Cl.
CPC ..... *B24B 37/005* (2013.01); *B24B 37/30* (2013.01); *B24B 49/16* (2013.01)

(58) Field of Classification Search
CPC ..... B24B 37/105; B24B 37/005; B24B 37/30
See application file for complete search history.

(56) References Cited

U.S. PATENT DOCUMENTS 4,742,651 A * 5/1988 Wittstock ..... B24B 37/005 451/24
5,486,265 A 1/1996 Salugsugan
(Continued)

FOREIGN PATENT DOCUMENTS

CN 113001395 A 6/2021
JP H03213268 A 9/1991
(Continued)

OTHER PUBLICATIONS

Written Opinion of PCT/JP2022/036377, Mailed on Nov. 8, 2022 (no translation included), in 4 pages.
(Continued)

*Primary Examiner* — Sean M Michalski
(74) *Attorney, Agent, or Firm* — K&L Gates LLP; Brian J. Novak; Giorgios N. Kefallinos

(57) ABSTRACT

A polishing device includes a wafer holder (31) that holds a wafer (W) and that brings the held wafer (W) into contact with a polishing surface (22*a*); a polishing plate driver (24) or a head driver (34) that, when polishing the wafer (W),
(Continued)

relatively rotates the wafer holder (31) with respect to the polishing surface (22*a*) to which a slurry (SL) is supplied; a polishing pressure applier (32) that applies polishing pressure to the wafer (W) by pressing the wafer (W) against the polishing surface (22*a*) via the wafer holder (31); and a controller (50) that, during polishing of the wafer (W), cyclically switches a state of the polishing pressure applied to the wafer (W) via the polishing pressure applier (32) between a high pressure state and a low pressure state in which the polishing pressure is lower than in the high pressure state.

11 Claims, 8 Drawing Sheets

(56) References Cited

U.S. PATENT DOCUMENTS

| | | | | |
|---|---|---|---|---|
| 6,129,610 | A | 10/2000 | Stephens | |
| 6,354,928 | B1 | 3/2002 | Crevasse et al. | |
| 6,464,563 | B1 * | 10/2002 | Lensing | B24B 37/005 451/6 |
| 8,369,978 | B2 * | 2/2013 | David | B24B 37/005 700/109 |
| 10,702,972 | B2 | 7/2020 | Fukushima et al. | |
| 12,115,619 | B2 * | 10/2024 | E | B23Q 3/1546 |
| 2010/0258173 | A1 * | 10/2010 | Laia | B24B 37/042 451/36 |
| 2013/0017762 | A1 * | 1/2013 | Thaldorf | B24B 37/005 451/5 |
| 2014/0138355 | A1 * | 5/2014 | Yavelberg | B24B 7/228 216/53 |
| 2015/0266159 | A1 * | 9/2015 | Shiokawa | B24B 37/005 451/5 |
| 2015/0352686 | A1 * | 12/2015 | Wu | B24B 49/04 438/693 |
| 2017/0190020 | A1 * | 7/2017 | Kobayashi | B24B 49/05 |
| 2018/0369985 | A1 | 12/2018 | Kawasaki et al. | |
| 2022/0203498 | A1 * | 6/2022 | Suzuki | B24B 37/013 |

FOREIGN PATENT DOCUMENTS

| | | | |
|---|---|---|---|
| JP | H1126405 | A | 1/1999 |
| JP | 2017112302 | A | 6/2017 |
| WO | 2023/054562 | A1 | 4/2023 |

OTHER PUBLICATIONS

Office Action, dated Mar. 17, 2026 for Chinese Patent Application No. 202280065425.3 (Original and Translation enclosed).

Extended European Search Report, mailed Sep. 16, 2025, for corresponding European Patent Application Serial No. 22876426.2.

* cited by examiner

POLISHING DEVICE, POLISHING METHOD, AND COMPUTER-READABLE STORAGE MEDIUM

PRIORITY CLAIM

This application is a national phase entry of PCT Application No. PCT/JP2022/036377, filed on Sep. 29, 2022, which claims priority to Japanese Patent Application No. 2021-161159, filed on Sep. 30, 2021, the entire disclosures of which are incorporated by reference herein.

TECHNICAL FIELD

The present application relates to a polishing device, a polishing method, and a program.

BACKGROUND ART

For example, the wafer polishing method disclosed in Patent Literature 1 includes, in a state in which a slurry is supplied onto a rotating polishing plate to which a polishing pad is adhered, polishing one side of a wafer by rotating the rotating polishing plate and a pressure application head while applying pressure to the wafer by the pressure application head.

CITATION LIST

Patent Literature

Patent Literature 1: Unexamined Japanese Patent Application Publication No. 2017-112302

SUMMARY OF INVENTION

Technical Problem

In the wafer polishing method described above, it is thought that Preston's law, which states that the processing rate is positively proportional to the polishing pressure by the pressure application head, always holds true. However, the present inventors discovered that there are conditions under which the processing rate is less likely to increase in accordance with Preston's law even when increasing the polishing pressure.

The present disclosure is made with the view of the above situation, and an objective of the present disclosure is to provide a polishing device, a polishing method, and a program whereby it is possible to more reliably increase the processing rate by increasing the polishing pressure.

Solution to Problem

In order to achieve the objective described above, a polishing device according to a first aspect of the present disclosure includes: a wafer holder that holds a wafer and that brings the held wafer into contact with a polishing surface; a driver that, when polishing the wafer, relatively rotates the wafer holder with respect to the polishing surface to which a slurry is supplied; a polishing pressure applier that applies polishing pressure to the wafer by pressing the wafer against the polishing surface via the wafer holder; and a controller that, during polishing of the wafer, cyclically switches a state of the polishing pressure applied to the wafer by the polishing pressure applier between a high pressure state and a low pressure state in which the polishing pressure is lower than in the high pressure state.

In order to achieve the objective described above, a polishing method according to a second aspect of the present disclosure includes: bringing a wafer held by a wafer holder into contact with a polishing surface; when polishing the wafer, relatively rotating, by a driver, the wafer holder with respect to the polishing surface to which a slurry is supplied; and during polishing of the wafer, cyclically switching a state of the polishing pressure applied to the wafer by the polishing pressure applier between a high pressure state and a low pressure state in which the polishing pressure is lower than in the high pressure state.

In order to achieve the objective described above, a program according to a third aspect of the present disclosure causes a computer to realize a function of, when polishing, by a polishing surface, a wafer held by a wafer holder in cooperation with a slurry, cyclically switching a state of polishing pressure applied to the wafer by a polishing pressure applier between a high pressure state and a low pressure state in which the polishing pressure is lower than in the high pressure.

Advantageous Effects of Invention

According to the present disclosure, it is possible to more reliably increase the processing rate by increasing the polishing pressure.

DESCRIPTION OF EMBODIMENTS

Various embodiments of a polishing device, a polishing method, and a program according to the present disclosure are described while referencing the drawings.

Figure 1:
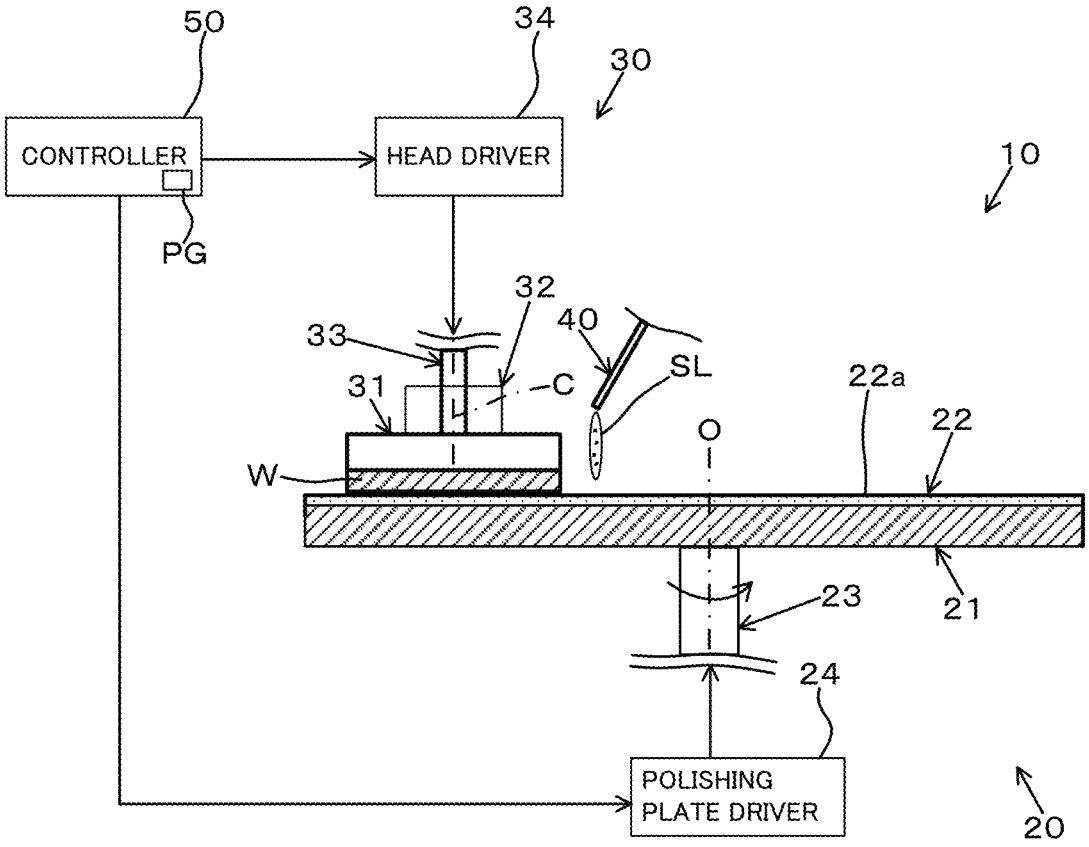
FIG. 1 is a schematic drawing of a polishing device according to an embodiment of the present disclosure.

As illustrated in FIG. 1, a polishing device 10 is a chemical mechanical polishing (CMP) device. The polishing device 10 includes a polishing plate 20, a head device 30, a slurry supplier 40, and a controller 50.

The polishing plate 20 includes a polishing surface 22*a* that polishes a wafer W held by the head device 30. The wafer W has a disc shape and is formed from gallium nitride (GaN), silicon carbide (SiC), silicon nitride (SiN), aluminum nitride (AlN), or diamond (C). The polishing plate 20 includes a polishing plate main body 21, a polishing pad 22, a rotational shaft 23, and a polishing plate driver 24.

The polishing plate main body 21 is formed in a disc shape. The rotational shaft 23 extends along a center axis O of the polishing plate main body 21, and connects to the polishing plate main body 21. The polishing plate driver 24 axially rotates the rotational shaft 23 to rotate the polishing plate main body 21 with the center axis O as a rotational axis.

The polishing pad 22 is formed on a surface, of the polishing plate main body 21, opposing the head device 30. In one example, the polishing pad 22 is formed from a foamed resin, a non-foamed resin, a nonwoven fabric, or a polishing fabric. A polishing surface 22*a* is formed on a surface of the polishing pad 22 opposing the head device 30.

The slurry supplier 40 supplies a slurry SL to the polishing surface 22*a*. The slurry SL includes a plurality of abrasive grains for polishing. The supplied slurry SL enters between the polishing surface 22*a* and the wafer W during polishing of the wafer W.

The head device 30 holds the wafer W, presses the held wafer W against the polishing surface 22*a*, and rotates the held wafer W. The head device 30 includes a wafer holder 31, a polishing pressure applier 32, a rotational shaft 33, and a head driver 34.

The wafer holder 31 holds the wafer W by air suction force. In this example, the wafer holder 31 is formed in disc shape, and the wafer W is held on a surface of the wafer holder 31 opposing the polishing surface 22*a*.

The rotational shaft 33 extends along a center axis C of the wafer holder 31, and connects to the wafer holder 31. The head driver 34 axially rotates the rotational shaft 33 to rotate the wafer holder 31 with the center axis C as a rotational axis.

A different method, such as fixing by wax or the like, may be used for the holding of the wafer W.

The polishing pressure applier 32 applies polishing pressure to the wafer W by pressing the wafer W, held by the wafer holder 31, against the polishing surface 22*a*. In this example, the polishing pressure applier 32 utilizes a magnetic repulsive force to apply the polishing pressure to the wafer W.

Figure 2:
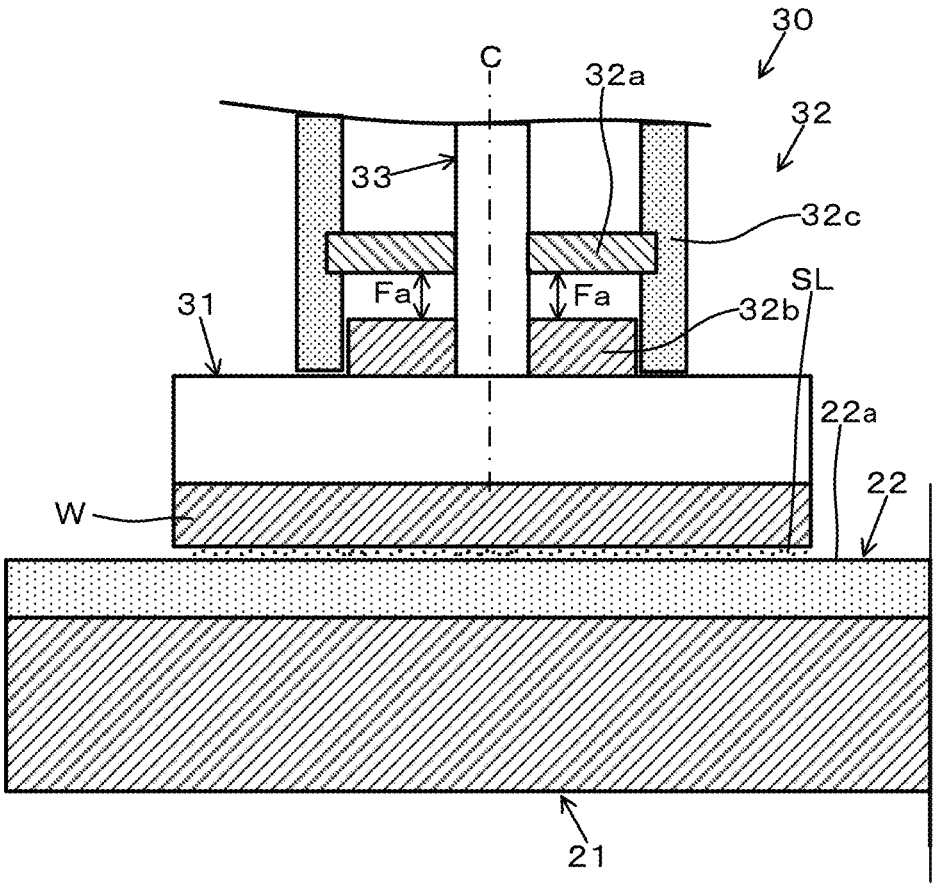
FIG. 2 is a schematic drawing of a head device according to an embodiment of the present disclosure.

Specifically, as illustrated in FIG. 2, the polishing pressure applier 32 includes an electromagnet 32*a*, a permanent magnet 32*b*, and an electromagnet holder 32*c*.

The permanent magnet 32*b* is positioned on a back surface of the wafer holder 31, and has a ring shape that surrounds the rotational shaft 33.

The electromagnet holder 32*c* holds the electromagnet 32*a* on a back side of the permanent magnet 32*b* (side of the permanent magnet 32*b* far from the polishing surface 22*a*). The electromagnet holder 32*c* has a cylinder shape that surrounds the rotational shaft 33, and holds the electromagnet 32*a* on an inner circumferential surface of the electromagnet holder 32*c*. The electromagnet holder 32*c* and the electromagnet 32*a* are provided in a state that does not rotate with respect to the rotation of the rotational shaft 33.

The electromagnet 32*a* is positioned with a space on the back side of the permanent magnet 32*b*, and has a ring shape that surrounds the rotational shaft 33.

The electromagnet 32*a* switches between an ON state and an OFF state on the basis of control by the controller 50 (see FIG. 1). The electromagnet 32*a* assumes the ON state when energized. In the ON state, the electromagnet 32*a* exerts a magnetic repulsive force Fa with respect to the permanent magnet 32*b*. In a repulsive force application state in which the repulsive force Fa acts on the wafer holder 31, the wafer holder 31 is pressed against the polishing surface 22*a* via the wafer W. As a result, a high pressure state is assumed in which polishing pressure is applied to the wafer W. The electromagnet 32*a* assumes the OFF state when energization is stopped. When the electromagnet 32*a* is in the OFF state, the electromagnet 32*a* is in a no-repulsive force state in which the repulsive force Fa is eliminated. As a result, the polishing pressure applied to the wafer W assumes a low pressure state. In the low pressure state, the polishing pressure is lower than in the high pressure state and, in this example, the polishing pressure is substantially zero. Here, the phrase "substantially zero" includes zero. Additionally, in one example, "substantially zero" is set to a range including the polishing pressure that is generated due to the dead weight of the head device 30. Note that it is sufficient that the polishing pressure in the low pressure state be lower than the polishing pressure in the high pressure state, and need not necessarily be substantially zero.

As illustrated in FIG. 1, the controller 50 controls the polishing pressure applier 32, the head driver 34, the polishing plate driver 24, and the slurry supplier 40. The controller 50 includes a processor such as a central processing unit (CPU) or the like, and storage such as read-only memory (ROM), random access memory (RAM), or the like.

The controller 50 executes polishing processing in accordance with a program PG stored in the storage in advance. In the polishing processing the controller 50 firstly holds the wafer W via the wafer holder 31. Then, the controller 50 uses a non-illustrated movement mechanism to move the wafer holder 31 so as to approach the polishing surface 22*a*, and bring the wafer W held by the wafer holder 31 into contact with the polishing surface 22*a*. At this time, the electromagnet 32*a* of the polishing pressure applier 32 is OFF.

Next, the controller 50 supplies the slurry SL via the slurry supplier 40 to the polishing surface 22*a*, rotates the wafer holder 31 via the head driver 34, and rotates the polishing plate main body 21 via the polishing plate driver 24 to polish the wafer W.

Figure 3:
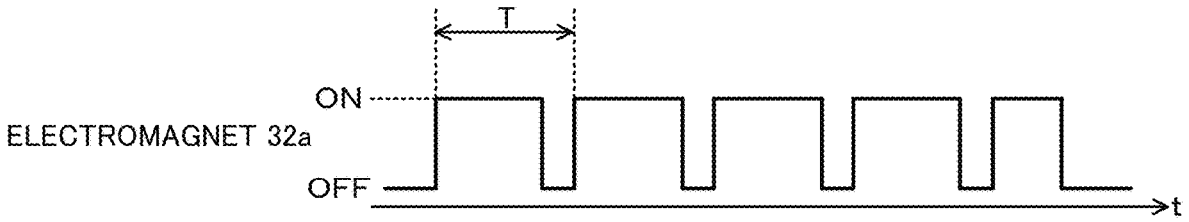
FIG. 3 is a time chart illustrating an ON/OFF state of an electromagnet according to an embodiment of the present disclosure.
Figure 4:
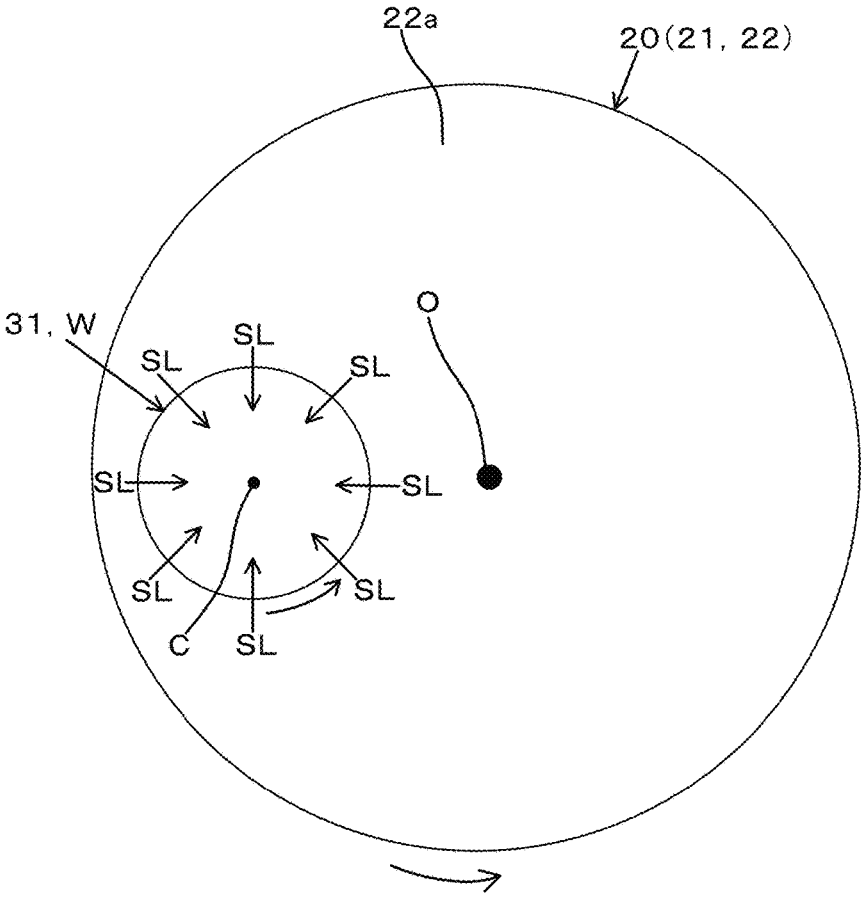
FIG. 4 is a schematic drawing of the polishing device according to an embodiment of the present disclosure, viewed from a direction along a rotational axis of a polishing plate.

During the polishing of the wafer W, as illustrated in FIG. 3, the controller 50 performs a switching operation for cyclically switching the state of the electromagnet 32*a* of the polishing pressure applier 32 between the ON state and the OFF state. As a result, the polishing pressure cyclically switches between the high pressure state and the low pressure state. Thus, the polishing pressure is cyclically set to the low pressure state and, as a result, as illustrated in FIG. 4, the slurry SL can more easily reach a center section of the wafer W between the polishing surface 22*a* and the wafer W. As a result, the slurry SL can be evenly supplied to the surface to be polished of the wafer W. Accordingly, unevennesses of the amount of polishing of the wafer W can be reduced. Due to this, a processing rate, which is the amount of polishing per unit hour, can be enhanced.

For example, the controller 50 switches from the ON state to the OFF state one time every few seconds to tens of seconds, for example, every 5 to 50 seconds. An OFF period in one cycle T is set shorter than an ON period.

Figure 5:
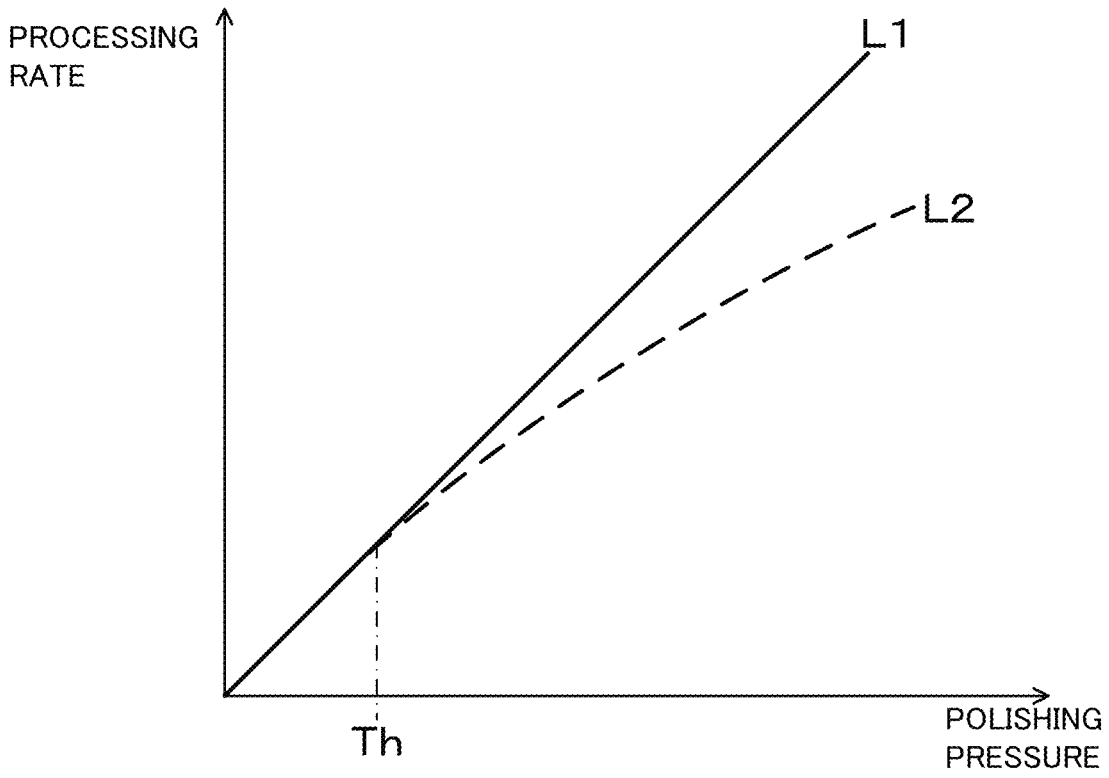
FIG. 5 is a graph illustrating the relationship between polishing pressure and a processing rate according to an embodiment of the present disclosure.

Conventionally, in a CMP, it is thought that Preston's law, which states that, at a constant rate of increase, the processing rate increases as the polishing pressure increases, will hold as illustrated by the solid line L1 of the graph of FIG. 5. However, for example, as illustrated by the dashed line L2 of the graph of FIG. 5, when the wafer W is a difficult-to-process material with a high hardness, the processing rate is less likely to increase even when increasing the polishing pressure, and Preston's law does not hold. The phenomenon of the processing rate being less likely to increase becomes more prominent as the polishing pressure increases. One cause of the processing rate being less likely to increase is that, when the polishing pressure increases, it is more difficult for the slurry SL to enter between the wafer W and the polishing surface 22*a* during polishing; in particular, it is more difficult for the slurry SL to reach the center section of the wafer W. To address this problem, in the present embodiment, the polishing pressure is cyclically switched between the high pressure state and the low pressure state and, as a result, it is easier for the slurry SL to enter between the wafer W and the polishing surface 22*a* during polishing; in particular, it is easier for the slurry SL to reach the center section of the wafer W. As a result, even in situations when the polishing pressure is high, the processing rate can be increased as the polishing pressure increases in accordance with Preston's law.

The difficult-to-process material of the wafer W is, for example, sapphire ($Al_2O_3$), gallium nitride (GaN), silicon carbide (SiC), silicon nitride (SiN), aluminum nitride (AlN), diamond (C), or the like.

The following values are processing rates of various representative materials of wafers:

Silicon (Si): 10 μm/h
$Al_2O$: 0.5 to 2 μm/h
GaN: 10 to 100 nm/h
SiC: 10 to 100 nm/h
SiN: 10 to 100 nm/h
AlN: 10 to 100 nm/h
C: 0.1 to 1 nm/h Lower processing rates indicate higher hardness and greater time required for polishing. As such, the phenomenon of the processing rate being less likely to increase is more likely to becomes prominent as the processing rate decreases. Therefore, cyclically switching the polishing pressure such as in the present embodiment is particularly beneficial when the wafer W is a difficult-to-process material. The difficult-to-process material may, for example, be defined as a material that has a processing rate of 3 μm/h or less. Additionally, a lower limit of the processing rate of the difficult-to-process material may be any value. For example, the lower limit may be set to 0.1 nm/h. For example, the wafer W may be a difficult-to-process material that has a processing rate in a range of 0.1 nm/h to 3 μm/h.

According to the embodiment described above, the following effects are demonstrated.

(1) The polishing device 10 includes the wafer holder 31 that holds the wafer W and that brings the held wafer W into contact with the polishing surface 22*a*; the polishing plate driver 24 or the head driver 34 that is an example of a driver that, when polishing the wafer W, relatively rotates the wafer holder 31 with respect to the polishing surface 22*a* to which the slurry SL is supplied; the polishing pressure applier 32 that applies the polishing pressure to the wafer W by pressing the wafer W against the polishing surface 22*a* by the wafer holder 31; and the controller 50 that, during polishing of the wafer W, cyclically switches the state of the polishing pressure applied to the wafer W via the polishing pressure applier 32 between the high pressure state and the low pressure state in which the polishing pressure is lower than in the high pressure state.

According to this configuration, during polishing of the wafer W the polishing pressure applied to the wafer W is switched to the low pressure state reduced from the high pressure state, every predetermined time interval and, as such, it is easier for the slurry SL to enter between the wafer W and the polishing surface 22*a*; in particular, it is easier for the slurry SL to reach the center section of the wafer W. Therefore, it is possible to more reliably increase the processing rate by increasing the polishing pressure. Additionally, the amount of consumption of the slurry SL can be reduced.

Furthermore, generally, frictional heat generated between the wafer W and the polishing surface 22*a* during polishing increases as a result of increasing the polishing pressure. According to the configuration described above, the polishing pressure is cyclically released and, as such, temperature increases due to frictional heat can be suppressed. Additionally, the lifetime of the polishing pad 22 can be extended, and the replacement frequency of the polishing pad 22 can be reduced.

Moreover, according to the configuration described above, it is not necessary to excessively increase the polishing pressure in order to increase the processing rate. As such, increases of the size of the polishing device 10 required to increase the polishing pressure can be suppressed. Furthermore, there is a concern that, when the state in which the polishing pressure is high continues, the slurry SL will solidify, and the solidified grains will damage the wafer W. However, according to the configuration described above, the state in which the polishing pressure is high does not continue and, as such, solidification of the slurry SL can be suppressed and, by extension, damaging of the wafer W by the solidified grains can be suppressed.

(2) The polishing pressure applier 32 switches between the repulsive force application state in which the magnetic repulsive force is applied to the wafer holder 31 in order to set the polishing pressure to the high pressure state, and the no-repulsive force state in which the magnetic repulsive force Fa is eliminated in order to set the polishing pressure to the low pressure state.

According to this configuration, the magnetic repulsive force Fa is used to generate the polishing pressure and, as such, it is possible to instantaneously switch the polishing pressure between the high pressure state and the low pressure state. With the configuration described above, the state of the polishing pressure can be more rapidly switched compared to, for example, a configuration in which the polishing pressure is applied or released by an air cylinder. As a result, decreasing of the processing rate can be suppressed.

By using the magnetic repulsive force Fa to generate the polishing pressure, the polishing pressure can be more evenly applied in the surface direction of the wafer W compared to a case in which the polishing pressure is generated by an air cylinder or the like. As a result, unevennesses of the amount of polishing in the surface direction of the wafer W can be reduced.

(3) The wafer W is formed from gallium nitride (GaN), silicon carbide (SiC), silicon nitride (SiN), aluminum nitride (AlN), or diamond (C).

When the wafer W is a difficult-to-process material such as gallium nitride (GaN), silicon carbide (SiC), silicon nitride (SiN), aluminum nitride (AlN), diamond (C), or the like, the phenomenon of the processing rate being less likely to increase even when the polishing pressure is increased becomes prominent. However, according to the configuration described above, the polishing pressure is cyclically switched between the high pressure state and the low pressure state. Due to this, even when a difficult-to-process material is used, the processing rate can be increased by increasing the polishing pressure.

(4) The polishing method for polishing the wafer W using the polishing device 10 includes bringing the wafer W held by the wafer holder 31 into contact with the polishing surface 22*a*; when polishing the wafer W, relatively rotating, by the polishing plate driver 24 or the head driver 34, the wafer holder 31 with respect to the polishing surface 22*a* to which the slurry SL is supplied; and, during polishing of the wafer W, cyclically switching the state of the polishing pressure applied to the wafer W by the polishing pressure applier 32 between the high pressure state and the low pressure state in which the polishing pressure is lower than in the high pressure state.

According to this configuration it is possible to more reliably increase the processing rate by increasing the polishing pressure.

(5) The program PG for polishing the wafer W by the polishing device 10 causes the controller 50, that is an example of a computer, to realize a function of, when polishing, by the polishing surface 22*a*, the wafer W held by the wafer holder 31 in cooperation with the slurry SL, cyclically switching the polishing pressure applied to the wafer W by the polishing pressure applier 32 between the high pressure state and the low pressure state in which the polishing pressure is lower than in the high pressure state.

According to this configuration it is possible to more reliably increase the processing rate by increasing the polishing pressure.

Note that the present disclosure is not limited by the embodiment and drawings described above, and modifications (including the omission of constituents) and the like can be made, as appropriate, without departing from the scope of the disclosure. Next, examples of modified examples are described.

Modified Examples

Figure 6:
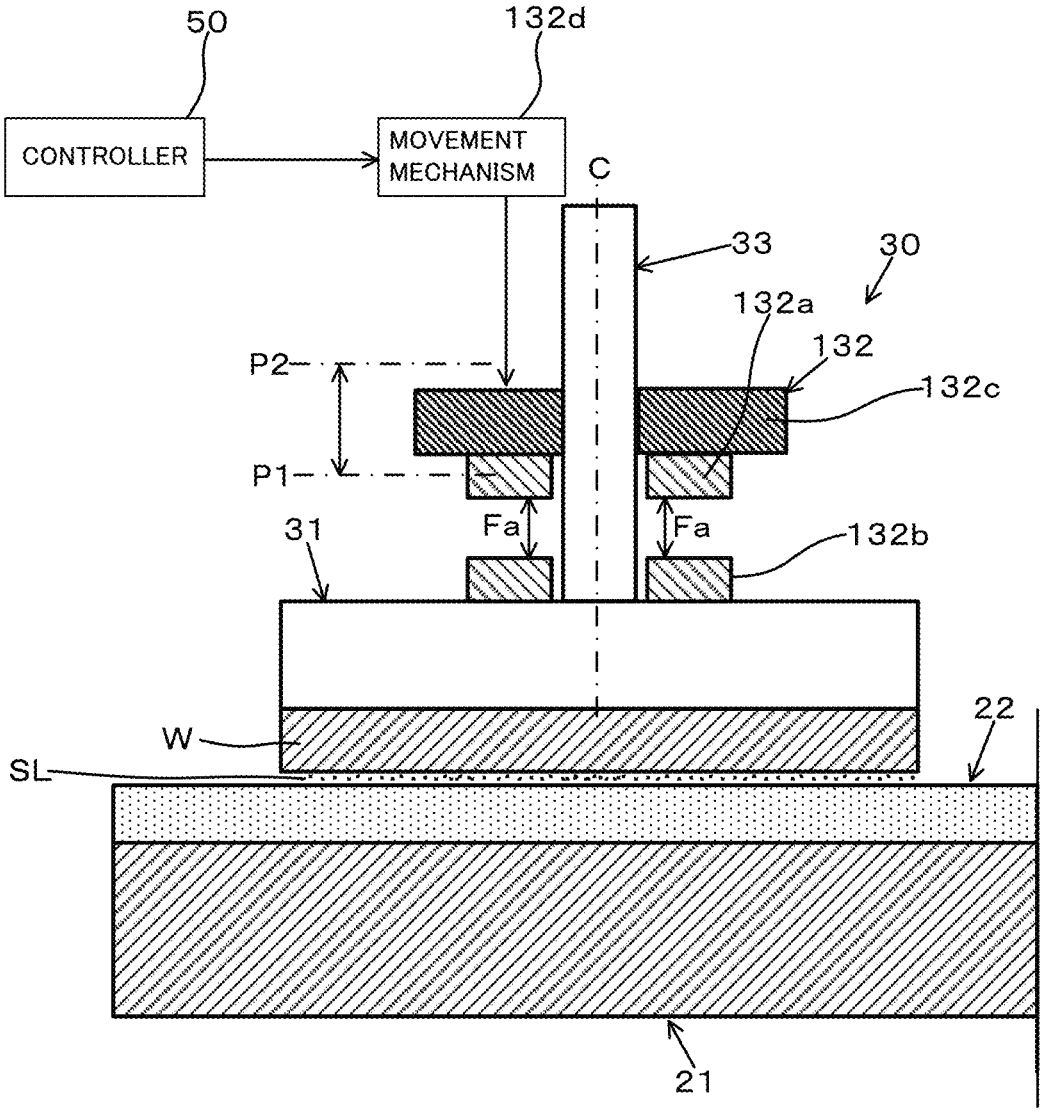
FIG. 6 is a schematic drawing of a polishing device according to a modified example of the present disclosure.

In the embodiment described above, the polishing pressure applier 32 applies polishing pressure by the repulsive force resulting from the combination of the electromagnet 32*a* and the permanent magnet 32*b*. However, a configuration is possible in which polishing pressure is applied by the repulsive force resulting from a combination of two permanent magnets. For example, as illustrated in FIG. 6, a polishing pressure applier 132 includes two permanent magnets 132*a*, 132*b*, a holding member 132*c* that holds the permanent magnet 132*a*, and a movement mechanism 132*d* that moves the position of the permanent magnet 132*a* with respect to the permanent magnet 132*b*. The two permanent magnets 132*a*, 132*b* have a shape that surrounds the rotational shaft 33, and have identical poles at mutually opposing positions. As with the permanent magnet 32*b* of FIG. 2, the permanent magnet 132*b* is disposed on the back surface of the wafer holder 31. In this example, a plurality of the permanent magnet 132*b* are disposed at equal angular spacings along the perimeter of the rotational shaft 33. The movement mechanism 132*d* moves, under the control of the controller 50, the permanent magnet 132*a* together with the holding member 132*c* between a proximate position P1 and a separated position P2. The proximate position P1 is a position at which the magnetic repulsive force Fa is generated between the permanent magnet 132*a* and the permanent magnet 132*b*. When the permanent magnet 132*a* is at the proximate position P1, the polishing pressure of the high pressure state is applied to the wafer W. The separated position P2 is a position at which the magnetic repulsive force Fa between the permanent magnet 132*a* and the permanent magnet 132*b* is eliminated, and the polishing pressure is in the low pressure state. When the permanent magnet 132*a* is at the separated position P2, the polishing pressure on the wafer W is released and approaches zero. A configuration is possible in which, for example, the movement mechanism 132*d* is implemented as a motor and a transfer mechanism that converts the rotational motion of the motor to linear motion and transfers that linear motion to the holding member 132*c*, or is implemented as an actuator such as a solenoid or the like. The controller 50 causes the permanent magnet 132*a* to cyclically move back and forth between the proximate position P1 and the separated position P2 during polishing of the wafer W. Due to this, effects similar to the switching operation of cyclically switching the state of the electromagnet 32*a* of the embodiment described above between the ON state and the OFF state can be obtained.

In this modified example and the embodiment described above, the polishing pressure applier 32, 132 applies polishing pressure to the wafer W by magnetism, but the method of applying polishing pressure is not limited to magnetism and a configuration is possible in which polishing pressure is applied to the wafer W by fluid pressure from a fluid cylinder such as an air cylinder, a hydraulic cylinder, or the like.

Furthermore, a configuration is possible in which the polishing pressure applier 32, 132 is capable of moving the wafer holder 31 with respect to the polishing surface 22*a*, in a direction orthogonal to the polishing surface 22*a*. In such a case, the polishing pressure applier 32, 132 may be configured such that the state is switchable between a contact state in which the wafer W held by the wafer holder 31 is brought into contact with the polishing surface 22*a*, and a separated state in which the wafer W is separated from the polishing surface 22*a*. In the contact state, the high pressure state described above is assumed. In the separated state, the low pressure state described above is assumed. In this modified example, the same configuration as a polishing device 10A, described later, may be used, for example. In this modified example, the controller 50 uses the polishing pressure applier 32, 132 to cyclically switch the state between the contact state and the separated state. Due to this, effects similar to the embodiment described above can be obtained.

In the embodiment described above, the controller 50 performs the switching operation of cyclically switching the state of the polishing pressure between the high pressure state and the low pressure state during polishing of the wafer W. However, the present disclosure is not limited thereto, and a configuration is possible in which the controller 50 performs the switching operation only when a predetermined condition is met during the polishing of the wafer W. For example, a configuration is possible in which the controller 50 always maintains the polishing pressure in the high pressure state when the polishing pressure is less than a threshold Th (see FIG. 5), and performs the switching operation when the polishing pressure is greater than or equal to the threshold Th. The threshold Th is set on the basis of the polishing pressure at which deviation from the ideal solid line L1 based on Preston's law is expected. The polishing pressure to be compared against the threshold Th may be detected by a pressure sensor.

Additionally, a configuration is possible in which, as the polishing pressure increases, the controller 50 reduces an ON duty ratio that is a ratio of the period that the high pressure state occupies in the switching cycle between the high pressure state and the low pressure state. The period of the low pressure state in the switching cycle increases as a result of the ON duty ratio decreasing. Furthermore, a configuration is possible in which the controller 50 shortens the switching cycle as the polishing pressure increases. The state switches quickly between the high pressure state and the low pressure state due to the shortening of the switching cycle.

Additionally, a configuration is possible in which the controller 50 reduces the ON duty ratio and/or shortens the switching cycle as the relative rotational speed of the wafer W relative to the polishing surface 22*a* increases.

Moreover, a configuration is possible in which, in the embodiment described above, the polishing pressure is cyclically switched between the high pressure state and the low pressure state by cyclically switching the ON/OFF state by using switching means such as a timer or the like that switches the ON/OFF state of the power of the polishing device 10. In such a case, the switching means are configured as the controller 50.

In the embodiment described above, the wafer W is formed from the difficult-to-process material such as gallium nitride (GaN) or the like. However, the present disclosure is not limited thereto, and a configuration is possible in which the wafer W is formed from a material other than the difficult-to-process material such as, for example, silicon (Si).

Additionally, a configuration is possible in which one of the polishing plate driver 24 and the head driver 34 is omitted.

The present disclosure may be applied to the program PG for polishing the wafer W. In such a case, the program PG may be stored on a non-transitory computer-readable recording medium such as universal serial bus (USB) memory, a CD-ROM, a digital versatile disc (DVD), a hard disk drive (HDD), or the like, and downloaded to a computer via a network.

Experiment Examples

Figure 7:
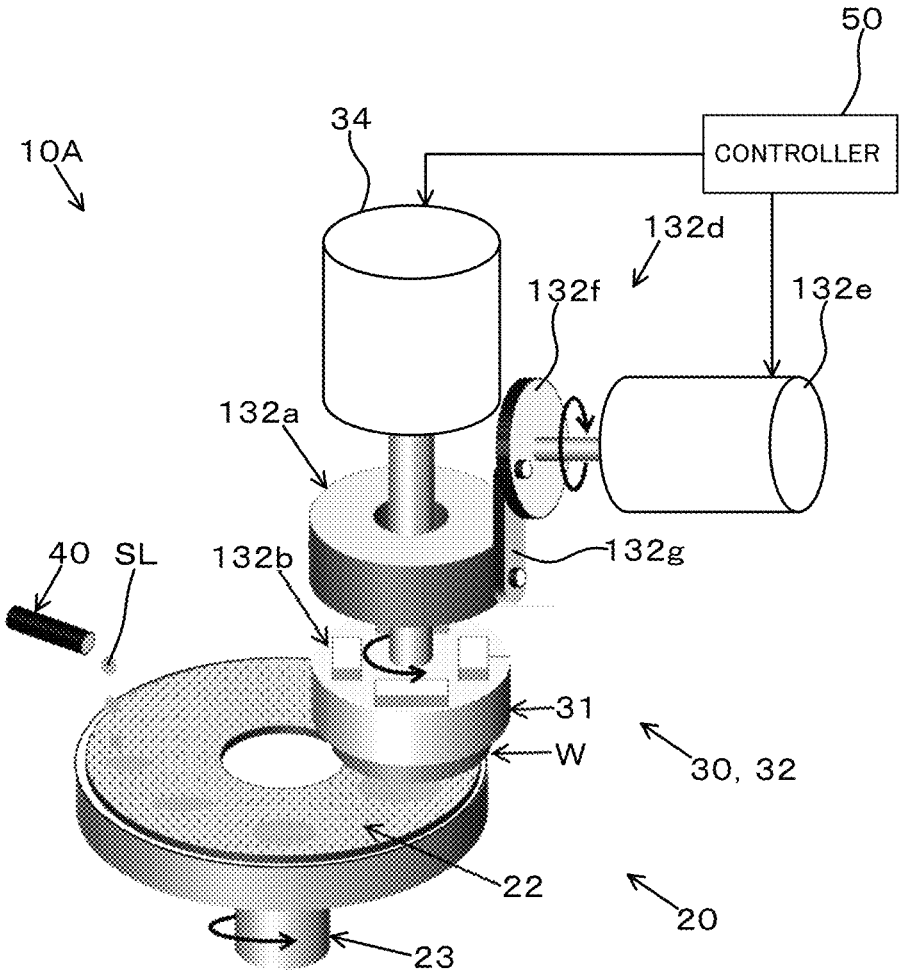
FIG. 7 is a schematic drawing of a polishing device used in an experiment.

The present inventors conducted an experiment to investigate the processing rate using, as a prototype, a polishing device 10A illustrated in FIG. 7. The polishing device 10A includes the polishing plate 20, the head device 30, the slurry supplier 40, and the controller 50. The polishing pressure applier 32 of the head device 30 includes the permanent magnets 132*a*, 132*b*, and the movement mechanism 132*d*. The movement mechanism 132*d* includes a motor 132*e*, a rotational member 132*f*, and a coupling member 132*g*. The motor 132*e* rotates the disc shaped rotational member 132*f* on the basis of control by the controller 50. A first end of the coupling member 132*g* is rotatably coupled to a non-center position of the rotational member 132*f* by a hinge, and a second end of the coupling member 132*g* is rotatably coupled to the permanent magnet 132*a* by a hinge. When the motor 132*e* rotates the rotational member 132*f*, the coupling member 132*g* moves, as a result of this rotation, the permanent magnet 132*a* in a direction away from or towards the permanent magnet 132*b*. In other words, due to the motor 132*e* being driven, a crank mechanism consisting of the rotational member 132*f* and the coupling member 132*g* operates and, due to the operation of the crank mechanism, the permanent magnet 132*a* moves back and forth in a direction away from or towards the permanent magnet 132*b*. When the permanent magnet 132*a* approaches the permanent magnet 132*b*, the polishing pressure applied to the wafer W becomes the high pressure state and, when the permanent magnet 132*a* moves away from the permanent magnet 132*b*, the polishing pressure becomes the low pressure state in which the polishing pressure is lower than in the high pressure state.

TABLE 1

| PROCESSING CONDITION | APPLIED LOAD METHOD: CONSTANT METHOD | APPLIED LOAD METHOD: VARIATION METHOD |
|---|---|---|
| SAMPLE | 2-INCH SAPPHIRE SUBSTRATE | |
| POLISHING PAD | SUEDE TYPE | |
| SLURRY | COLLOIDAL SILICA | |
| APPLIED LOAD (kPa) | 14.7, 27.5, 39.2 | VARIATION RANGE: 14.7 to 39.2 CYCLE (s): 6, 15, 24, 30, 38, 48 |
| POLISHING PLATE ROTATIONAL SPEED ($min^{-1}$) | 50 | |
| HEAD ROTATIONAL SPEED ($min^{-1}$) | 40 | |

In the present experiment, based on the conditions of Table 1, two types of methods are investigated, namely, as a comparative example, a constant method in which the polishing pressure is constant, and a variation method in which the polishing pressure is cyclically varied between the high pressure state and the low pressure state, described above in the embodiment.

Figure 8A:
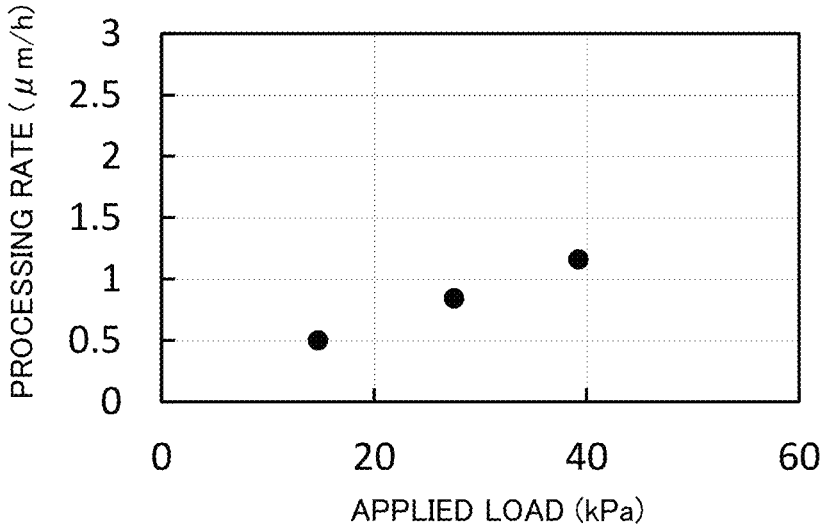
FIG. 8A is a graph illustrating experiment results of a constant method according to an experiment example.

In the experiment according to the comparative example, the constant method in which the applied load, which is the polishing pressure, is one of 14.7 kPa, 27.5 kPa, and 39.2 kPa is performed. In the results of the experiment according to the comparative example, as illustrated in FIG. 8A, as the polishing pressure (the applied load) increases, the processing rate increases and Preston's law holds. The maximum value of the processing rate, namely 1.16 μm/h, is realized when the applied load is 39.2 kPa.

Figure 8B:
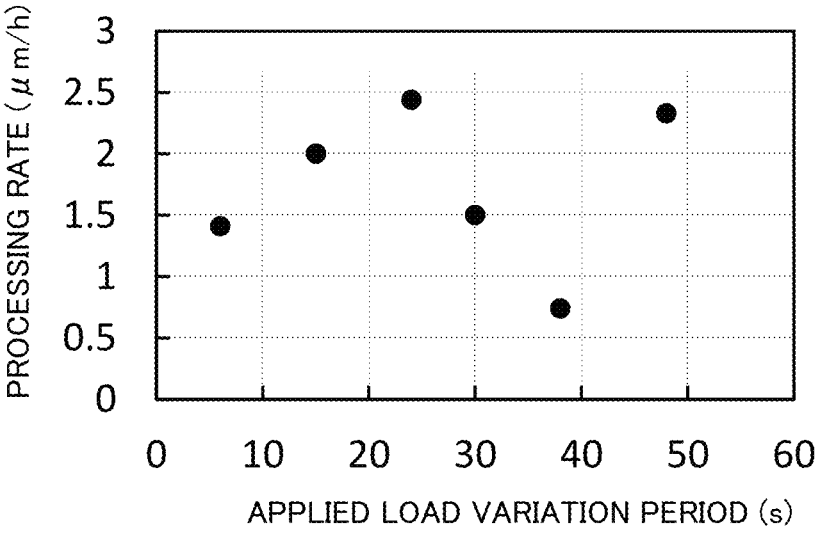
FIG. 8B is a graph illustrating experiment results of a variation method according to an experiment example.
Figure 9:
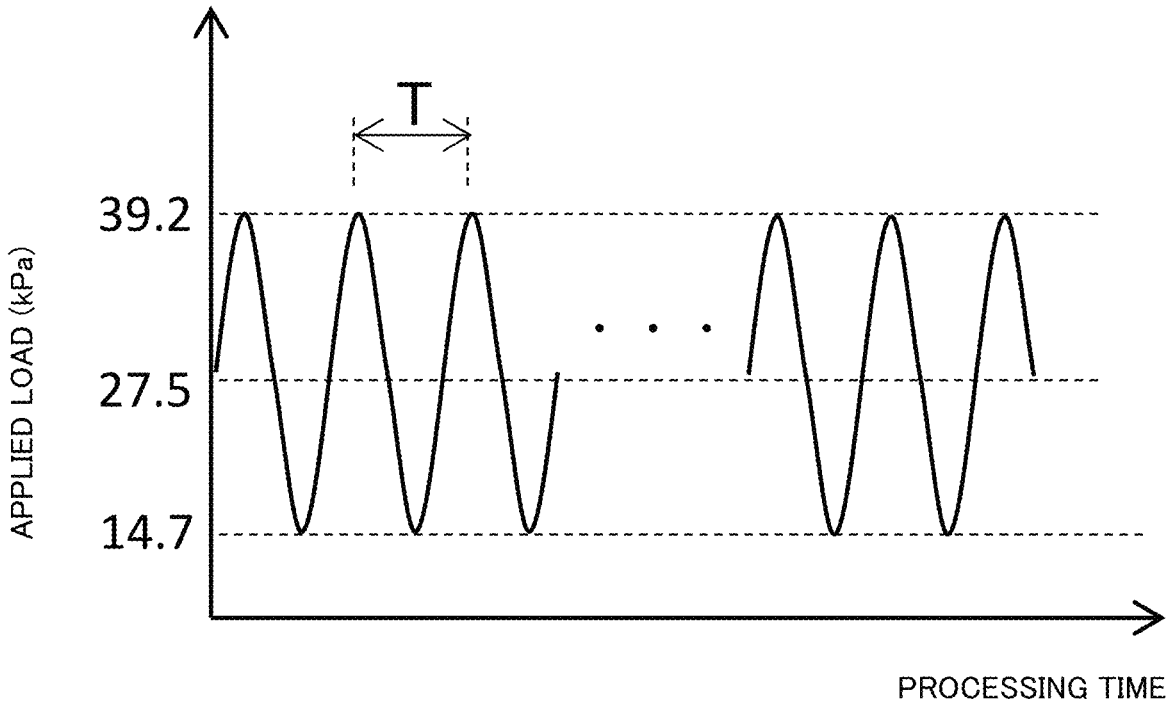
FIG. 9 is a graph illustrating variation of an applied load in the variation method of the experiment.

Next, an experiment according to the variation method using the polishing device 10A illustrated in FIG. 7 is described. As illustrated in FIG. 9, this experiment is carried out using a variation method in which the applied load is varied cyclically in a sinusoidal manner so that a median value is 27.5 kPa, a minimum value is 14.7 kPa, and a maximum value is 39.2 kPa. This experiment is carried out under six conditions of the cycle T being 6 seconds, 15 seconds, 24 seconds, 30 seconds, 38 seconds, and 48 seconds. As illustrated in FIG. 8B, the processing rate is 1.41 μm/h when the cycle T is 6 seconds. The processing rate is 2.00 μm/h when the cycle Tis 15 seconds. The processing rate is 2.44 μm/h when the cycle Tis 24 seconds. The processing rate is 1.50 μm/h when the cycle T is 30 seconds. The processing rate is 0.74 μm/h when the cycle Tis 38 seconds. The processing rate is 2.33 μm/h when the cycle T is 48 seconds. Among the six conditions of the cycle T, under the five conditions other than the condition of 38 seconds, the maximum value of the processing rate increased compared to that of the experiment according to the comparative example. Therefore, it is found that cyclically varying the polishing pressure contributes to increasing the processing rate.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2021-161159, filed on Sep. 30, 2021, the entire disclosure of which is incorporated by reference herein.

REFERENCE SIGNS LIST

10, 10A Polishing device
20 Polishing plate
21 Polishing plate main body
22 Polishing pad
22*a* Polishing surface
23, 33 Rotational shaft
24 Polishing plate driver
30 Head device
31 Wafer holder
32, 132 Polishing pressure applier
32*a* Electromagnet
32*b*, 132*a*, 132*b* Permanent magnet
32*c* Electromagnet holder
34 Head driver
40 Slurry supplier
50 Controller
132*c* Holding member
132*d* Movement mechanism
132*e* Motor
132*f* Rotation member
132*g* Coupling member
C, O Center axis
L1 Solid line
L2 Dashed line
P1 Proximate position
P2 Separated position
T Period
W Wafer
SL Slurry
Fa Repulsive force
Th Threshold

The invention claimed is:

1. A polishing device comprising:

a wafer holder that holds a wafer and that brings the wafer into contact with a polishing surface to polish the wafer;

a driver that, when polishing the wafer, relatively rotates the wafer holder with respect to the polishing surface to which a slurry is supplied;

a polishing pressure applier that applies polishing pressure to the wafer by pressing the wafer against the polishing surface via the wafer holder; and a controller configured to:

during polishing of the wafer, switch a state of the polishing pressure applied to the wafer by the polishing pressure applier between a high pressure state and a low pressure state in which the polishing pressure is lower than in the high pressure state;

maintain the polishing pressure in the high pressure state when the polishing pressure is less than a threshold that is set based on a polishing pressure at which deviation from an ideal is expected; and cyclically switch the state of the polishing pressure between the high pressure state and the low pressure state when the polishing pressure is greater than or equal to the threshold.

2. The polishing device according to claim 1, wherein the threshold is set based on a polishing pressure at which deviation from an ideal solid line based on Preston's law is expected.

3. The polishing device according to claim 1, further comprising:

a pressure sensor that detects the polishing pressure, wherein the controller compares, against the threshold, the polishing pressure detected by the polishing pressure.

4. The polishing device according to claim 1, wherein the polishing pressure applier switches between a repulsive force application state, in which magnetic repulsive force is applied to the wafer holder in order to set the polishing pressure to the high pressure state, and a no-repulsive force state, in which the magnetic repulsive force is eliminated in order to set the polishing pressure to the low pressure state.

5. The polishing device according to claim 1, wherein the wafer is formed from a material selected from a group consisting of gallium nitride, silicon carbide, silicon nitride, aluminum nitride, and diamond.

6. A polishing method comprising:

bringing a wafer held by a wafer holder into contact with a polishing surface to polish the wafer;

applying a polishing pressure to the wafer by a polishing pressure applier, a state of the polishing pressure applied to the wafer by the polishing pressure applier being switchable between a high pressure state and a low pressure state in which the polishing pressure is lower than in the high pressure state;

relatively rotating, by a driver, the wafer holder with respect to the polishing surface to which a slurry is supplied;

maintaining the polishing pressure in the high pressure state when the polishing pressure is less than a threshold that is set based on a polishing pressure at which deviation from an ideal is expected; and cyclically switching the state of the polishing pressure between the high pressure state and the low pressure state when the polishing pressure is greater than or equal to the threshold.

7. The polishing method according to claim 6, wherein the threshold is set based on a polishing pressure at which deviation from an ideal solid line based on Preston's law is expected.

8. The polishing method according to claim 6, wherein the polishing pressure to be compared against the threshold is detected by a pressure sensor.

9. A non-transitory computer-readable storage medium storing a program for causing a computer to execute processing comprising:

when polishing, by a polishing surface, a wafer held by a wafer holder in cooperation with a slurry, switching a state of polishing pressure applied to the wafer by a polishing pressure applier between a high pressure state and a low pressure state in which the polishing pressure is lower than in the high pressure;

maintaining the polishing pressure in the high pressure state when the polishing pressure is less than a threshold that is set based on a polishing pressure at which deviation from an ideal is expected; and cyclically switching the state of the polishing pressure between the high pressure state and the low pressure state when the polishing pressure is greater than or equal to the threshold.

10. The non-transitory computer-readable storage medium according to claim 9, wherein the threshold is set based on a polishing pressure at which deviation from an ideal solid line based on Preston's law is expected.

11. The non-transitory computer-readable storage medium according to claim 9, wherein the polishing pressure to be compared against the threshold is detected by a pressure sensor.

* * * * *